US007992397B2

(12) United States Patent
Nemoto et al.

(10) Patent No.: US 7,992,397 B2
(45) Date of Patent: Aug. 9, 2011

(54) AMMONIA/$CO_2$ REFRIGERATION SYSTEM, $CO_2$ BRINE PRODUCTION SYSTEM FOR USE THEREIN, AND AMMONIA COOLING UNIT INCORPORATING THAT PRODUCTION SYSTEM

(75) Inventors: Takashi Nemoto, Koto-ku (JP); Akira Taniyama, Koto-ku (JP); Shinjirou Akaboshi, Koto-ku (JP); Iwao Terashima, Koto-ku (JP)

(73) Assignee: Mayekawa Mfg. Co., Ltd. (JP)

( * ) Notice: Subject to any disclaimer, the term of this patent is extended or adjusted under 35 U.S.C. 154(b) by 442 days.

(21) Appl. No.: 11/437,023

(22) Filed: May 19, 2006

(65) Prior Publication Data

US 2006/0266058 A1 Nov. 30, 2006

Related U.S. Application Data

(63) Continuation of application No. PCT/JP2004/000122, filed on Jan. 9, 2004.

(30) Foreign Application Priority Data

Nov. 21, 2003 (JP) ..... 2003-391715

(51) Int. Cl.

| | |
|---|---|
| ***F25B 39/04*** | (2006.01) |
| ***F25B 7/00*** | (2006.01) |
| ***C09K 5/04*** | (2006.01) |
| ***F25D 17/02*** | (2006.01) |
| ***F25D 25/04*** | (2006.01) |

(52) U.S. Cl. ..... 62/183; 62/114; 62/185; 62/335; 62/380; 62/434

(58) Field of Classification Search ..... 62/183, 62/114, 185, 380, 434, 335

See application file for complete search history.

(56) References Cited

U.S. PATENT DOCUMENTS 2,195,228 A * 3/1940 Schwarz ..... 62/113

(Continued)

FOREIGN PATENT DOCUMENTS

EP 1162414 * 12/2001

(Continued)

OTHER PUBLICATIONS

Machine translations of the following Publications from the JPO website: JP 9-243186 A Sep. 16, 1997 Ito et al. JP 2002-243290 A Aug. 28, 2002 Kuwako et al.*

(Continued)

*Primary Examiner* — Frantz F Jules
*Assistant Examiner* — Filip Zec
(74) *Attorney, Agent, or Firm* — Rossi, Kimms & McDowell LLP

(57) ABSTRACT

An ammonia/$CO_2$ refrigeration system is provided in which the ammonia cycle and $CO_2$ brine cycle can be combined without problems even when refrigeration load such as refrigerating showcase, etc. is located at any place in accordance with circumstances of customer's convenience. The system comprises apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side cooler, wherein said liquid pump is a variable-discharge pump for allowing $CO_2$ to be circulated forcibly, and the forced circulation flow is determined so that $CO_2$ is recovered from the outlet of the cooler of the refrigeration load side in a liquid or liquid/gas mixed state.

24 Claims, 10 Drawing Sheets

U.S. PATENT DOCUMENTS

| | | | | | |
|---|---|---|---|---|---|
| 2,359,595 | A | * | 10/1944 | Urban | 62/149 |
| 3,345,828 | A | * | 10/1967 | Klee et al. | 62/63 |
| 3,607,756 | A | * | 9/1971 | Phillips | 252/73 |
| 3,643,451 | A | * | 2/1972 | Foucar | 62/623 |
| 4,130,997 | A | | 12/1978 | Hara et al. | |
| 5,120,558 | A | * | 6/1992 | Nguyen et al. | 426/425 |
| 5,207,072 | A | * | 5/1993 | Arno et al. | 62/196.3 |
| 5,363,670 | A | * | 11/1994 | Bartilucci | 62/166 |
| 5,400,615 | A | | 3/1995 | Pearson | |
| 5,442,931 | A | | 8/1995 | Ryan et al. | |
| 5,651,257 | A | * | 7/1997 | Kasahara et al. | 62/84 |
| 5,968,312 | A | * | 10/1999 | Sephton | 159/47.1 |
| 6,000,233 | A | | 12/1999 | Nishida et al. | |
| 6,112,532 | A | | 9/2000 | Bakken | |
| 6,349,558 | B1 | | 2/2002 | Ichikawa et al. | |
| 6,568,195 | B2 | * | 5/2003 | Kaimai et al. | 62/114 |
| 6,619,066 | B1 | * | 9/2003 | Kaneo | 62/324.2 |
| 6,966,196 | B2 | * | 11/2005 | Matsuki et al. | 62/305 |
| 2004/0211553 | A1 | * | 10/2004 | Hancock | 165/260 |

FOREIGN PATENT DOCUMENTS

| | | | |
|---|---|---|---|
| JP | 52-70473 | A | 6/1977 |
| JP | 4-76393 | A | 3/1992 |
| JP | 5-118622 | A | 5/1993 |
| JP | 7-27456 | A | 1/1995 |
| JP | 9-89493 | A | 4/1997 |
| JP | 9-243186 | A | 9/1997 |
| JP | 10-246547 | A | 9/1998 |
| JP | 2000-274789 | A | 10/2000 |
| JP | 2001-507784 | A | 6/2001 |
| JP | 2002-210329 | A | 7/2002 |
| JP | 2002-243290 | A | 8/2002 |
| JP | 2003-065618 | A | 3/2003 |
| JP | 2003-166765 | A | 6/2003 |
| JP | 2003-232583 | A | 8/2003 |
| JP | 3458310 | B2 | 8/2003 |
| WO | WO 00/49346 | A1 | 8/2000 |
| WO | WO 00/50822 | A1 | 8/2000 |

OTHER PUBLICATIONS

JP 2003-065618 A Mar. 5, 2003 Mizukami JP 10-246547 A Sep. 14, 1998 Hata et al.*

JP 2002-210329 A Jul. 30, 2002 Kanao.*

JP 5-118622 A May 14, 1993 Nishio et al.*

Relevant portion of International Search Report of corresponding PCT Application PCT/JP2004/000122.

Office Action dated Jan. 23, 2008 issued in corresponding European Patent Application No. 04701120.0-2301.

Office Action dated Feb. 15, 2008 issued in corresponding Chinese Patent Application No. 2004800392958.

Office Action issued in corresponding Korean application No. 10-2006-7011761 dated Feb. 16, 2011.

Relevant portion of the International Search Report issued in corresponding PCT application SN. PCT/JP05/12232 with a mailing date of Oct. 11, 2005.

* cited by examiner

AMMONIA/$CO_2$ REFRIGERATION SYSTEM, $CO_2$ BRINE PRODUCTION SYSTEM FOR USE THEREIN, AND AMMONIA COOLING UNIT INCORPORATING THAT PRODUCTION SYSTEM

CROSS-REFERENCE TO RELATED APPLICATIONS

This application is a continuation of International Application PCT/JP2004/000122 having an international filing date of 9 Jan. 2004, and claims priority under 35 U.S.C. §119(a) to Japanese Application No. JP 2003-391715, filed on 21 Nov. 2003. The disclosure of the PCT and priority applications, in their entirety, including the drawings, claims, and the specification thereof, are incorporated herein by reference.

BACKGROUND

The present invention relates to a refrigeration system working on an ammonia refrigerating cycle and $CO_2$ refrigerating cycle, a system for producing $CO_2$ brine to be used therein, and a refrigerating unit using ammonia as a refrigerant and provided with the system for producing $CO_2$ brine. Specifically, the present invention relates to an ammonia refrigerating cycle, a brine cooler for cooling and liquefying $CO_2$ by utilizing the latent heat of vaporization of ammonia, an apparatus for producing $CO_2$ brine to be used for a refrigeration system having a liquid pump in a supply line for supplying to a refrigeration load side the liquefied $CO_2$ cooled and liquefied by said brine cooler, and an ammonia refrigerating unit provided with said brine producing apparatus.

Amid strong demand for preventing ozone layer destruction and global warming these days, it is imperative in the field of air conditioning and refrigeration not only to draw back from using CFCs from the viewpoint of preventing ozone layer destruction, but also to recover alternative compounds HFCs and to improve energy efficiency from the viewpoint of preventing global warming. To meet the demand, utilization of natural refrigerant such as ammonia, hydrocarbon, air, carbon dioxide, etc. is being considered, and ammonia is being used in many of large cooling/refrigerating equipment. The adoption of natural refrigerant also tends to be increasing in cooling/refrigerating equipment of small scale, such as a refrigerating storehouse, goods disposing rooms, and processing rooms, which are associated with said large cooling/refrigerating equipment.

However, as ammonia is toxic, a refrigerating cycle, in which an ammonia cycle and $CO_2$ cycle are combined, and $CO_2$ is used as a secondary refrigerant in a refrigeration load side, has been adopted in many of ice-making factories, refrigerating storehouses, and food refrigerating factories. A refrigeration system in which ammonia cycle and carbon dioxide cycle are combined is disclosed, for example, in Japanese patent No. 3458310. The system is composed as shown in FIG. 9(A). In the drawing, the ammonia cycle gaseous ammonia is first compressed by the compressor 104 and is cooled by cooling water or air to be liquefied when the ammonia gas passes through the condenser 105. The liquefied ammonia is expanded at the expansion valve 106, then evaporates in the cascade condenser 107 to be gasified. When evaporating, the ammonia receives heat from the carbon dioxide in the carbon dioxide cycle to liquefy the carbon dioxide. On the other hand, in the carbon dioxide cycle, the carbon dioxide cooled and liquefied in the cascade condenser 107 flows downward by its hydraulic head to pass through the flow adjusting valve 108 and enters the bottom feed type evaporator 109 to perform required cooling. The carbon dioxide heated and evaporated in the evaporator 109 returns again to the cascade condenser 107, thus the ammonia performs natural circulation.

In the system of the above-described prior art, the cascade condenser 107 is located at a position higher than that of the evaporator 108, for example, located on a rooftop. Accordingly, hydraulic head is produced between the cascade condenser 107 and the evaporator having a cooler fan 109*a*. The principle of this is explained with reference to FIG. 1(B) which is a pressure-enthalpy diagram. In the drawing, the broken line shows an ammonia refrigerating cycle using a compressor, and the solid line shows a $CO_2$ cycle by natural circulation which is possible by composing such that there is a hydraulic head between the cascade condenser 107 and the bottom feed type evaporator 109.

However, the prior art includes a fundamental disadvantage in that the cascade condenser (which works as an evaporator in the ammonia cycle to cool carbon dioxide) must be located at a position higher than the position of the evaporator (refrigerating showcase, etc.) for performing required cooling in the $CO_2$ cycle. Particularly, there may be a case that refrigerating showcases or freezer units are required to be installed at higher floors of high or middle-rise buildings at customers' convenience, and the system of the prior art absolutely cannot cope with such a case.

To deal with this, some of the systems provide a liquid pump 110 as shown in FIG. 9(B) in the carbon dioxide cycle to subserve the circulation of the carbon dioxide refrigerant to ensure more positive circulation. However, the liquid pump serves only as an auxiliary means and basically natural circulation for cooling carbon dioxide is generated by the hydraulic head between the condenser 107 and the evaporator 109 also in this prior art. That is, in the prior art, a pathway provided with the auxiliary pump is added parallel to the natural circulation route on condition that the natural circulation of $CO_2$ is produced by the utilization of the hydraulic head. (Therefore, the pathway provided with the auxiliary pump should be parallel to the natural circulation route.)

Particularly, the prior art of FIG. 9(B) utilizes the liquid pump on condition that the hydraulic head is secured, that is, on condition that the cascade condenser (an evaporator for cooling carbon dioxide refrigerant) is located at a position higher than the position of the evaporator for performing cooling in the carbon dioxide cycle, and above-mentioned fundamental disadvantage is not solved also in this prior art system. In addition, it is difficult to apply this prior art when evaporators (refrigerating showcases, cooling apparatuses, etc.) are to be located on the ground floor and the first floor and accordingly the hydraulic head between the cascade condenser and each of the evaporator will be different to each other.

In the prior art systems, there is a restriction for providing a hydraulic head between the cascade condenser 107 and the evaporator 109 that natural circulation does not occur unless the evaporator is of a bottom feed type which means that the inlet of $CO_2$ is located at the bottom of the evaporator and the outlet of $CO_2$ is provided at the top thereof as shown in FIG. 9(A) and FIG. 9(B). However, in the bottom feed type condenser, liquid $CO_2$ enters the cooling tube from the lower side evaporates in the cooling tube and flows upward while receiving heat, i.e. depriving heat of the air outside the cooling tube, and the evaporated gas flows upward in the cooling tube. So, in the cooling tube, the upper part is filled only with gaseous $CO_2$ resulting in poor cooling effect and only lower part of the cooling tube is effectively cooled. Further, when a liquid header is provided at the inlet side, uniform distribution of $CO_2$ in the cooling tube can not be realized. Actually, as can be seen in pressure-enthalpy diagram of FIG. 1(B), $CO_2$ is recovered to the cascade condenser after liquid is $CO_2$ perfectly evaporated.

A brine producing apparatus, which comprises an ammonia refrigerating cycle, a brine cooler for cooling and liquefying $CO_2$ by utilizing the latent heat of vaporization of ammonia, and an apparatus for producing $CO_2$ brine having a liquid pump in a supply line for supplying to a refrigeration load side the liquefied $CO_2$ cooled and liquefied by said brine cooler, is generally unitized. Particularly in the ammonia cycle, the condensing section where gaseous ammonia compressed by the compressor is condensed to liquid ammonia is composed as an evaporation type condenser using water or air as a cooling medium.

The construction of the ammonia refrigerating unit comprising the evaporation type condenser is disclosed in Japanese Laid-Open Patent Application 2003-232583 which was applied for by the same applicant of the present invention. The construction of the ammonia refrigerating unit of this prior art is shown in FIG. 10. The refrigerating unit is composed such that; a lower construction body 56 integrating a compressor 1, a brine cooler 3, an expansion valve 23, a high-pressure liquid ammonia refrigerant receiver 25, etc. is of a hermetically sealed structure; an upper construction body 55 located on said lower construction body 56 is of a double-shelled structure integrating a water sprinkler head 61 of an evaporation type condenser and a condensing section in which a heat exchanger 60 is integrated; a cooling fan 63 sucks cooling air from an air inlet provided in an outer casing 65, the cooling air being introduced to the heat exchanger 60 from under the evaporation type condenser; the cooling air together with the sprinkled water cools the high-pressure, high-temperature ammonia gas flowing in inclined cooling tubes of the heat exchanger 60 to condense the ammonia, the sprinkled water rendering leaked ammonia harmless by dissolving the leaked ammonia.

The evaporation type condenser is composed of the inclined multitubular heat exchanger 60, water sprinkler head 61, eliminators 64, and cooling fan 63 which sends out the air after heat exchanging. The outer casing 65 is provided to surround the cuboidal condensing section, the section including the heat exchanger 60, water sprinkler head 61, and eliminators 64, and being open downward to allow cooling air to be introduced into the condensing section in order to form the double-shelled structure.

The inclined multitubular heat exchanger 60 is composed of a pair of tube end supporting plates each having headers 60*c*, 60*d*, and a plurality of inclined cooling tubes 60*g*. Water is sprinkled from the water sprinkler head 61 provided above the heat exchanger 60 to the inclined cooling tubes 60*g* to cool the pipes utilizing the latent heat of vaporization of water. The cooling air introduced from the air inlet passes through the eliminators 64 and is sent out by the cooling fan provided above the eliminators 64.

A plurality of eliminators 64 are juxtaposed on a plane to prevent water droplets scattered from the sprinkler head 61 toward the inclined cooling tubes 10*g* from flying. Therefore, pressure loss of the air flow when the air sucked by the cooling fan 63 passes through the spaces between the eliminators 64 is large, which makes it necessary to increase fanning power resulting in an increased noise and driving power. (Arrows in the drawing indicate air flows.)

Further, in the case where apparatuses working on ammonia and some of the apparatuses working on carbon dioxide are unitized and accommodated in the lower construction body as mentioned above, it may happen that ammonia leaks from the bearings, etc. of the compressor. Although the lower compartment is hermetically sealed, a counter measure to deal with ammonia leakage is necessary to be provided because ammonia gas is toxic and inflammable.

SUMMARY OF THE INVENTION

The present invention was made in light of the problems mentioned above, and an object of the invention is to provide an ammonia/$CO_2$ refrigeration system and a $CO_2$ brine production system for use therein capable of constituting a cycle combining an ammonia cycle and a $CO_2$ cycle without problems, even when the $CO_2$ brine production system comprising apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side, and a refrigeration load side apparatus such as for example a freezer showcase are located in any place in accordance with circumstances of customer's convenience.

Another object of the invention is to provide a refrigeration system in which $CO_2$ circulation cycle can be formed irrespective of the position of the $CO_2$ cycle side cooler, kind thereof (bottom feed type or top feed type), and the number thereof, and further even when the $CO_2$ brine cooler is located at a position lower than the refrigeration load side cooler, and a $CO_2$ brine production system for use in the refrigeration system.

A further object of the invention is to provide an ammonia refrigerating unit integrated with a $CO_2$ brine production system in which, when eliminators are located between the condenser section and cooling fan, loss of cooling air flow passing through the eliminators can be decreased.

A still further object of the invention is to provide an ammonia cooling unit in which, when the unit is composed by unitizing an ammonia system and a part of a carbon dioxide system to be accommodated in a space, toxic ammonia leakage is easily detoxified and the occurrence of fire caused by ignition of ammonia gas can be easily prevented even if leakage occurs.

To achieve the above objects, the present invention includes a first embodiment having an ammonia/$CO_2$ refrigeration system comprising apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side cooler, wherein the liquid pump is a variable-discharge pump for allowing $CO_2$ to be forcibly circulated, and the forced circulation flow is determined so that $CO_2$ is recovered from the outlet of the refrigeration load side cooler in a liquid or liquid/gas mixed state.

It is preferable that a relief passage connecting the refrigeration load side cooler to the brine cooler is capable of allowing partial evaporation or to a liquid reservoir provided downstream thereof in addition to a $CO_2$ recovery passage connecting the outlet of said cooler to the brine cooler, and $CO_2$ pressure is relieved through said relief passage when the pressure in the load side cooler is equal to or higher than a predetermined value.

A plurality of the cooler capable of allowing evaporation in a liquid/gas mixed state (incompletely evaporated state) may be provided, and at least one of them may be of a top feed type.

It is suitable that the pump is connected to a drive capable of intermittent and/or variable-speed drive such as an inverter motor for example.

It is suitable that the pump is driven by an inverter motor and operated in combination of intermittent and speed controlling drive at starting to allow the pump to be operated under discharge pressure lower than designed permissible pressure and then operated while controlling rotation speed.

It is suitable that a supply line extending from the outlet of said pump is connected to the refrigeration load side by means of a heat insulated joint.

According to the invention, as the liquid pump is a variable discharge pump for allowing forced circulation of $CO_2$ and capable of discharging larger than 2 times, preferably 3~4 times the circulation flow required by the cooler of the refrigeration load side so that $CO_2$ is recovered from the outlet of the cooler of the refrigeration load side in a liquid/gas mixed state, $CO_2$ can be circulated smoothly in the $CO_2$ cycle even if the $CO_2$ brine cooler in the ammonia cycle is located in the basement of a building and the cooler capable of allowing evaporation in a liquid or liquid/gas mixed state (imperfectly evaporated state) such as a showcase, etc. is located at an arbitrary position above ground. Accordingly, the $CO_2$ cycle can be operated, when coolers (refrigerating showcases, room coolers, etc) are installed on the ground floor and first floor of a building, irrelevantly to the hydraulic head between each of the coolers and the $CO_2$ brine cooler.

Further, as the system is composed so that $CO_2$ is recovered to the brine cooler from the outlet of the cooler capable of allowing evaporation in a liquid or liquid/gas mixed state, $CO_2$ is maintained in a liquid/gas mixed state even in the upper parts of cooling tube of the cooler even when the cooler is of a bottom feed type. Therefore, there does not occur a situation that the upper part of the cooling tube is filled only with gaseous $CO_2$ resulting in insufficient cooling, so the cooling in the coolers is performed all over the cooling tubes effectively.

When the pump discharges 2 times or larger, preferably 3~4 times the circulation flow of $CO_2$ required by the cooler capable of allowing evaporation in a liquid or liquid/gas state (incompletely evaporated state), there is a danger that undesired pressure rise above permissible design pressure of the pump could occur at starting of the liquid pump, for the starting is done in a condition of normal temperature.

Therefore, it is suitable to combine intermittent operation and rotation speed control of the pump to allow the pump to be operated under discharge pressure lower than designed permissible pressure and then operated while controlling rotation speed.

To make such operation of the pump possible, it is suitable that the pump is connected to a drive capable of intermittent and/or variable-speed drive such as an inverter motor.

Further, it is suitable as a safety design to provide a pressure relief passage connecting the cooler of the refrigeration load side and the $CO_2$ brine cooler or the liquid reservoir provided downstream thereof in addition to the return passage connecting the outlet of the cooler to the $CO_2$ brine cooler so that pressure of $CO_2$ is allowed to escape through the pressure relief passage when the pressure in the load side cooler exceeds a predetermined pressure (near the design pressure, for example, the pressure at 90% load of the designed refrigeration load).

Further, the system of the invention can be applied when a plurality of load side coolers are provided and $CO_2$ is supplied to the coolers through passages branching from the liquid pump, or when refrigeration load varies largely, or even when at least one of the coolers is of a top feed type.

Further, $CO_2$ in the refrigeration load side must be recovered every time the operation of the system is finished before the pump is stopped. It is suitable that, when said refrigeration load is refrigerating equipment containing a cooler, the temperature of the space where said equipment is accommodated and $CO_2$ pressure at the outlet of the load side cooler are detected, and $CO_2$ recovery control is done in which the timing of stopping the cooling fan of the cooler is judged while judging the amount of $CO_2$ remaining in the cooler through the comparison of the saturation temperature of $CO_2$ at the detected temperature and the temperature of the space.

Further, when said refrigeration load is refrigerating equipment containing a defrosting type cooler, a time period for recovering $CO_2$ can be reduced by recovering while sprinkling water for defrosting.

In this case, it is suitable that $CO_2$ pressure at the outlet of the cooler is detected, and the amount of sprinkling water is controlled based on the detected pressure.

It is suitable that a supply line extending from the outlet of said pump is connected to the refrigeration load side by means of a heat insulated joint.

The present invention proposes as a second preferred embodiment a $CO_2$ brine production system comprising apparatuses working on an ammonia refrigerating cycle, a brine cooler for cooling and condensing $CO_2$ by utilizing the latent heat of vaporization of the ammonia, and a liquid pump provided in a supply line for supplying the cooled and liquefied $CO_2$ to a refrigeration load side, wherein said liquid pump is a variable-discharge pump for allowing $CO_2$ to be circulated forcibly, and the liquid pump is controlled to vary its discharge based on at least one of the detected signals of the temperature or pressure of a cooler capable of allowing evaporation in a liquid or liquid/gas mixed state provided to the refrigeration load side or pressure difference between the outlet and inlet of the pump.

In the invention, it is suitable that a supercooler is provided to supercool at least a part of the liquid $CO_2$ in a liquid reservoir provided for reserving the cooled and liquefied $CO_2$ based on the condition of cooled state of $CO_2$ in the liquid reservoir or in the supply line.

Further, it is suitable that the conditions of cooling of $CO_2$ is judged by a controller which determines the degree of supercooling by detecting the pressure and temperature of the liquid in the reservoir and comparing the saturation temperature at the detected pressure with the detected liquid temperature.

Further, it is suitable that a pressure sensor is provided for detecting pressure difference between the outlet and inlet of said liquid pump, and the conditions of cooling of $CO_2$ is judged based on the signal from said pressure sensor.

Specifically, the supercooler can be composed as an ammonia gas line branched to bypass a line for introducing ammonia to the evaporator of ammonia in the ammonia refrigerating cycle.

As another preferable embodiment of the invention, it is suitable that a bypass passage is provided to bypass between the outlet side of said liquid pump and the cooler capable of allowing partial evaporation by means of an open/close control valve.

As still another preferable embodiment of the invention, it is suitable that a controller is provided for forcibly unloading the compressor in the ammonia refrigerating cycle based on detected pressure difference between the outlet and inlet of said liquid pump. It is suitable that a heat insulated joint is used at the joining part of the brine line of the $CO_2$ brine producing side with the brine line of the refrigeration load side.

According to the second embodiment, $CO_2$ brine production system in which carbon dioxide ($CO_2$) is circulated as a secondary refrigerant by means of a liquid pump can be manufactured effectively. Particularly, according to the first and second embodiments, by adopting forced circulation by means of a liquid pump having a discharge capacity larger than the circulation flow required by the refrigeration load side (3~4 times the required flow), heat transmission is improved by allowing the cooler capable of allowing evaporation in a liquid or liquid/gas mixed state (incompletely evaporated state) to be filled by liquid and increasing the velocity of the liquid in the cooling tube, and further when a plurality of coolers are provided, the liquid can be distributed efficiently.

Further, by providing the supercooler inside or outside of the liquid reservoir for supercooling all or a part of the liquid in the liquid reservoir based on the condition of cooled state of liquid $CO_2$ in the liquid reservoir or in the supply line, stable degree of supercooling can be secured.

Further, by providing the bypass passage between the outlet of the liquid pump and the brine cooler to allow $CO_2$ to be bypassed through the open/close control valve to the brine cooler, even when degree of supercooling decreases at starting or when refrigeration fluctuates and pressure difference between the inlet and outlet of the pump decreases and cavitation state occurs, $CO_2$ in a liquid/gas mixed can be bypassed from the outlet of the pump to the brine cooler to allow $CO_2$ gas to be liquefied so that the cavitation state is eliminated early.

Further, if the controller is provided to unload the compressor in the ammonia cycle forcibly based on the detected pressure difference between the outlet and inlet of the liquid pump, the compressor can be unloaded forcibly when pressure difference between the inlet and outlet of the pump decreases and cavitation state occurs as mentioned above to allow apparent saturation temperature of $CO_2$ to rise to secure the degree of supercool in order to eliminate the cavitation state early.

The third embodiment relates to an ammonia cooling unit for producing $CO_2$ brine containing an ammonia compressor, a brine cooler for cooling and condensing $CO_2$ by utilizing the latent heat of vaporization of the ammonia, and a liquid pump provided in a supply line for supplying the cooled and liquefied $CO_2$ to a refrigeration load side located in the inside space of the unit, and is characterized in that said liquid pump is composed to be a variable-discharge pump controlled to vary its discharge to allow $CO_2$ to be circulated forcibly based on at least one of the detected signals of the temperature or pressure of a cooler provided to the refrigeration load side or pressure difference between the outlet and inlet of the pump, a water tank for detoxifying ammonia is provided in the inside space of the unit, and a neutralization line is provided for introducing $CO_2$ in the $CO_2$ system in the inside space of the unit to said water tank.

According to the invention, an effect is obtained in addition to the effects obtained by the first and second invention that, when ammonia leaks from the ammonia system accommodated in the inside space of the unit, carbon dioxide can be introduced to the ammonia detoxifying water tank to neutralize the alkaline water solution of ammonia in the tank.

Further, the invention is characterized in that said liquid pump is composed to be a variable-discharge pump controlled to vary its discharge to allow $CO_2$ to be circulated forcibly based on at least one of the detected signals of the temperature or pressure of a cooler provided to the refrigeration load side or pressure difference between the outlet and inlet of the pump, and a $CO_2$ injection line is provided for injecting $CO_2$ in the $CO_2$ system in the inside space of the unit toward a section facing the ammonia system.

According to the invention like this, an effect is obtained in addition to the effects obtained by the first and second invention that, when ammonia leaks from the ammonia system accommodated in the inside space of the unit, carbon dioxide can be spouted forcibly toward the ammonia system in the inside space of the unit so that there occurs a chemical reaction between the spouted carbon dioxide and leaked ammonia to produce ammonium carbonate to detoxify the leaked ammonia, and the safety of the system is further enhanced.

Further, the invention is characterized in that said liquid pump is composed to be a variable-discharge pump controlled to vary its discharge to allow $CO_2$ to be circulated forcibly based on at least one of the detected signals of the temperature or pressure of a cooler provided at the refrigeration load side or pressure difference between the outlet and inlet of the pump, a $CO_2$ spouting part is provided for releasing $CO_2$ in the $CO_2$ system to the inside space of the unit into the space, and open/close control of the spouting part is done based on the temperature of the space of the unit or the pressure in the $CO_2$ system.

According to the invention like this, an effect is obtained in addition to the effects obtained by the first and second invention that, when a fire occurs due to leakage of ammonia and temperature rises in the inside space of the unit or pressure rises in the $CO_2$ system, the fire can be extinguished or abnormal pressure rise can be eliminated by allowing carbon dioxide to be released from the $CO_2$ spouting part into the space.

Generally, in an apparatus using $CO_2$ as a refrigerant, pressure rise occurs when the apparatus is halted for an extended period of time. To deal with this, conventionally, forced operation of machines in the apparatus is done or small sized machines are provided for nonworking day. However, as $CO_2$ is safe even if it is released to the atmosphere, by releasing $CO_2$ from the $CO_2$ spouting part, an abnormal pressure rise can be eliminated.

It is suitable that said $CO_2$ spouting part for releasing $CO_2$ in the $CO_2$ system to the inside space of the unit is formed at the extremity of an injection line surrounding the liquid reservoir in which a supercooler is provided for supercooling the liquid $CO_2$ therein at least partially based on the condition of cooling of the liquid $CO_2$ in the liquid reservoir or in the supply line, or contacting the supercooler when the supercooler is provided outside the liquid reservoir. In this way, the safety of the system is enhanced, for $CO_2$ cooled in the injection line contacting the supercooler or surrounding the liquid reservoir is released from the spouting part.

The present invention proposes as a fourth embodiment of the invention an ammonia refrigerating unit for producing $CO_2$ brine containing an ammonia compressor, a brine cooler for cooling and condensing $CO_2$ by utilizing the latent heat of vaporization of the ammonia, a liquid pump provided in a supply line for supplying the cooled and liquefied $CO_2$ to a refrigeration load side located in the inside a closed space of the unit, on the other hand an evaporation type condenser is located in an opened space side of the unit, and the condenser is composed of a heat exchanger comprising cooling tubes, water sprinkler, a plurality of eliminators arranged side by side, and a cooling fan or fans, wherein said liquid pump is composed to be a variable-discharge pump controlled to vary its discharge to allow $CO_2$ to be circulated forcibly based on at least one of the detected signals of the temperature or pressure of a cooler provided at the refrigeration load side or pressure difference between the outlet and inlet of the pump, and wherein the eliminators positioned adjacent to each other are positioned to be stepped with each other so that the upper part of the side wall of an eliminator faces the lower part of the side wall of the adjacent eliminator.

According to this embodiment, an effect is obtained in addition to the effect obtained by the first embodiment of the invention in that pressure loss between the eliminators can be reduced, since the eliminators positioned adjacent to each other are positioned to be stepped with each other so that the upper part of the side wall of an eliminator faces the lower part of the side wall of the adjacent eliminator, as a result the height of the side wall parts of the eliminators directly facing to each other with a small gap which may generally be the case can be reduced.

Further, water droplets scattered from the sprinkler head impinge against the side walls of the eliminators located adjacent to the eliminators which are located in lower positions by the stepped arrangement of the eliminators, and the impinged droplets grow in its size and less tend to be sucked upward by the fan, thus flying out of water droplets is effectively prevented.

Further, according to the invention, by composing the heat exchanger to be an inclined multitubular heat exchanger having an inlet header for introducing compressed ammonia gas to be distributed to flow into the cooling tubes, and attaching a baffle plate to the header at a position facing the inlet opening for introducing compressed ammonia gas, ammonia gas introduced from the inlet opening impinges the baffle plate and evenly enters the tubes of the inclined multitubular heat exchanger.

BRIEF DESCRIPTION OF THE DRAWINGS

The invention will be described with reference to certain preferred embodiments of the invention and the accompanying drawings, wherein;

FIG. 1 represents pressure-enthalpy diagrams of a combined refrigerating cycle of ammonia and $CO_2$, wherein

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1B:
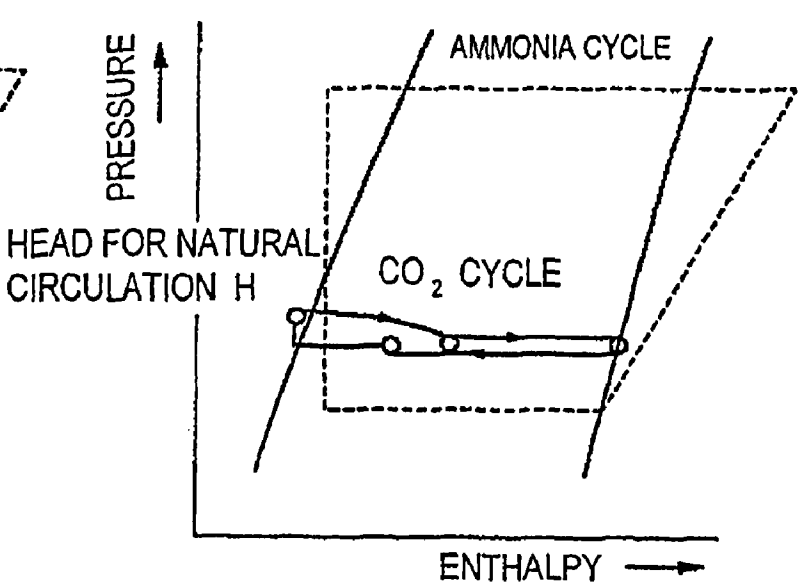
FIG. 1B Prior Art
FIG. 1(B) is a diagram of the cycle when working in the system of prior art.
Figure 1A:
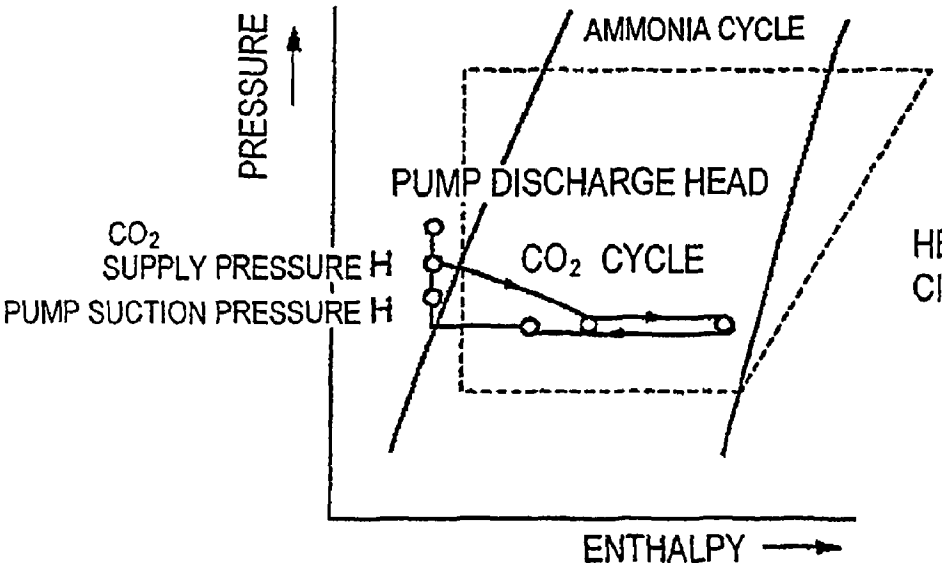
FIG. 1(A) is a diagram of the cycle when working in the system according to the present invention.

FIG. 1(A) is a pressure-enthalpy diagram of the ammonia cycle and that of $CO_2$ cycle of the present invention, in which the broken line shows an ammonia refrigerating cycle and the solid line shows a $CO_2$ cycle of forced circulation. Liquid $CO_2$ produced in a brine cooler is supplied to a refrigeration load side by means of a liquid pump to generate forced circulation of $CO_2$. The discharge capacity of the liquid pump is determined to be equal to or larger than two times the circulation flow required by the cooler side in which $CO_2$ of liquid or liquid/gas mixed state (imperfectly evaporated state) can be evaporated in order to allow $CO_2$ to be recovered to the brine cooler in a liquid state or liquid/gas mixed state. As a result, even if the brine cooler is located at the position lower than the refrigeration load side cooler, liquid $CO_2$ can be supplied to the refrigeration load side cooler and $CO_2$ can be returned to the brine cooler even if it is in a liquid or liquid/gas mixed state because enough pressure difference can be secured between the outlet of the cooler and the inlet of the brine cooler. (This is shown in FIG. 1(A) in which $CO_2$ cycle is returned before entering the gaseous zone.)

Therefore, as the system is constituted such that CO2 of liquid or liquid/gas mixed state can be returned to the brine cooler capable of allowing evaporation in a liquid or liquid/gas mixed state (incompletely evaporated state) even if there is not enough hydraulic head between the brine cooler and the refrigeration load side cooler and there is a somewhat long distance between them, the system can be applied to all refrigeration systems for cooling a plurality of rooms (coolers) irrespective of the type of cooler such as bottom feed type or top feed type.

Figure 2:
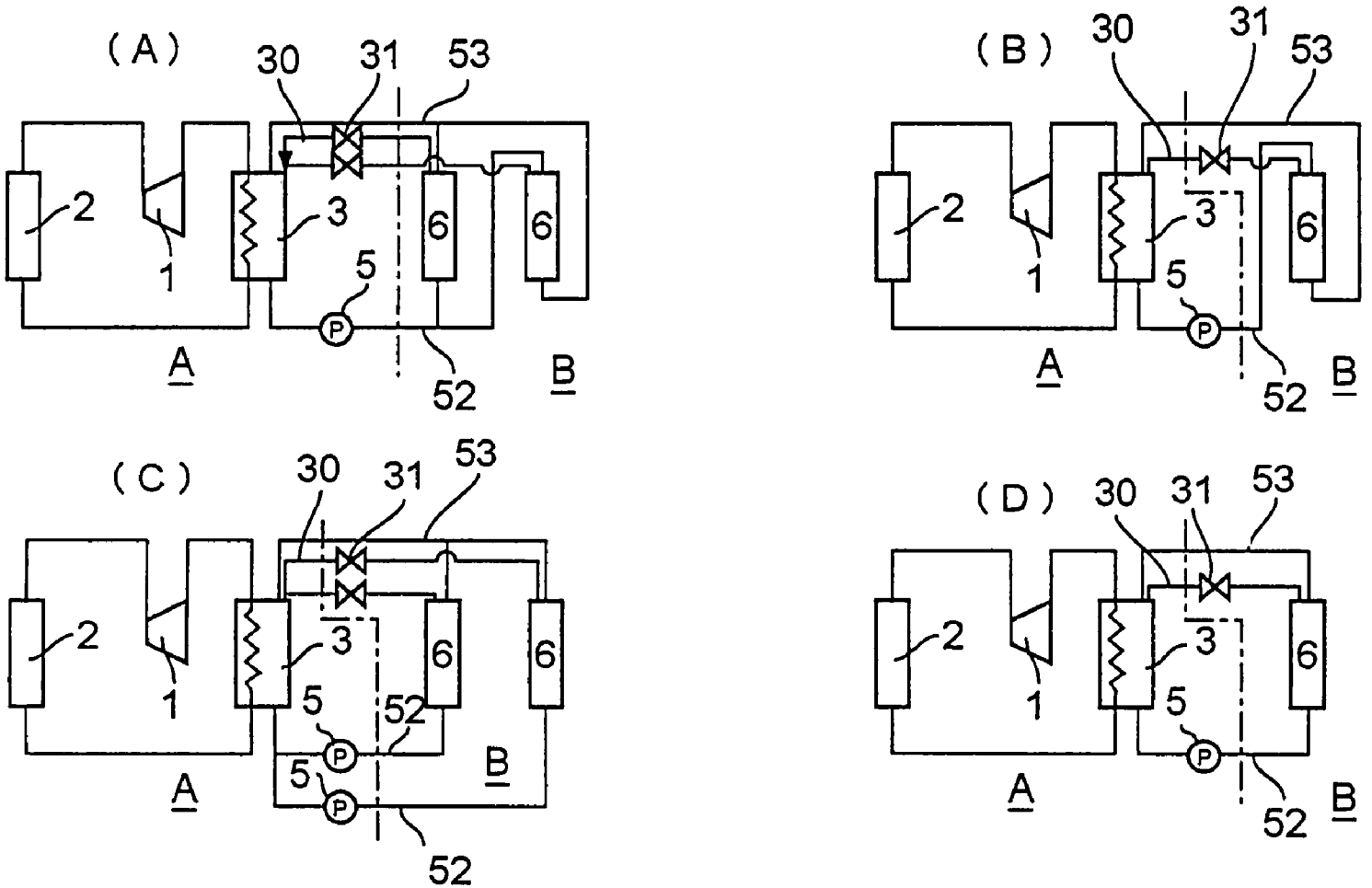
FIGS. 2(A)~(D) are a variety of connection diagrams of the first to fourth embodiments of the invention.

Various block diagrams are shown in FIG. 2. In the drawings, reference symbol A is a machine unit integrating an ammonia refrigerating cycle section and a machine unit ($CO_2$ brine producing apparatus) integrating a heat exchanging section of ammonia/$CO_2$ (which includes a brine cooler and a $CO_2$ pump) and reference symbol B is a freezer unit for cooling (freezing) refrigeration load side by the latent heat of vaporization and sensible heat of the $CO_2$ brine (liquid $CO_2$) produced in the machine unit A.

Figure 3:
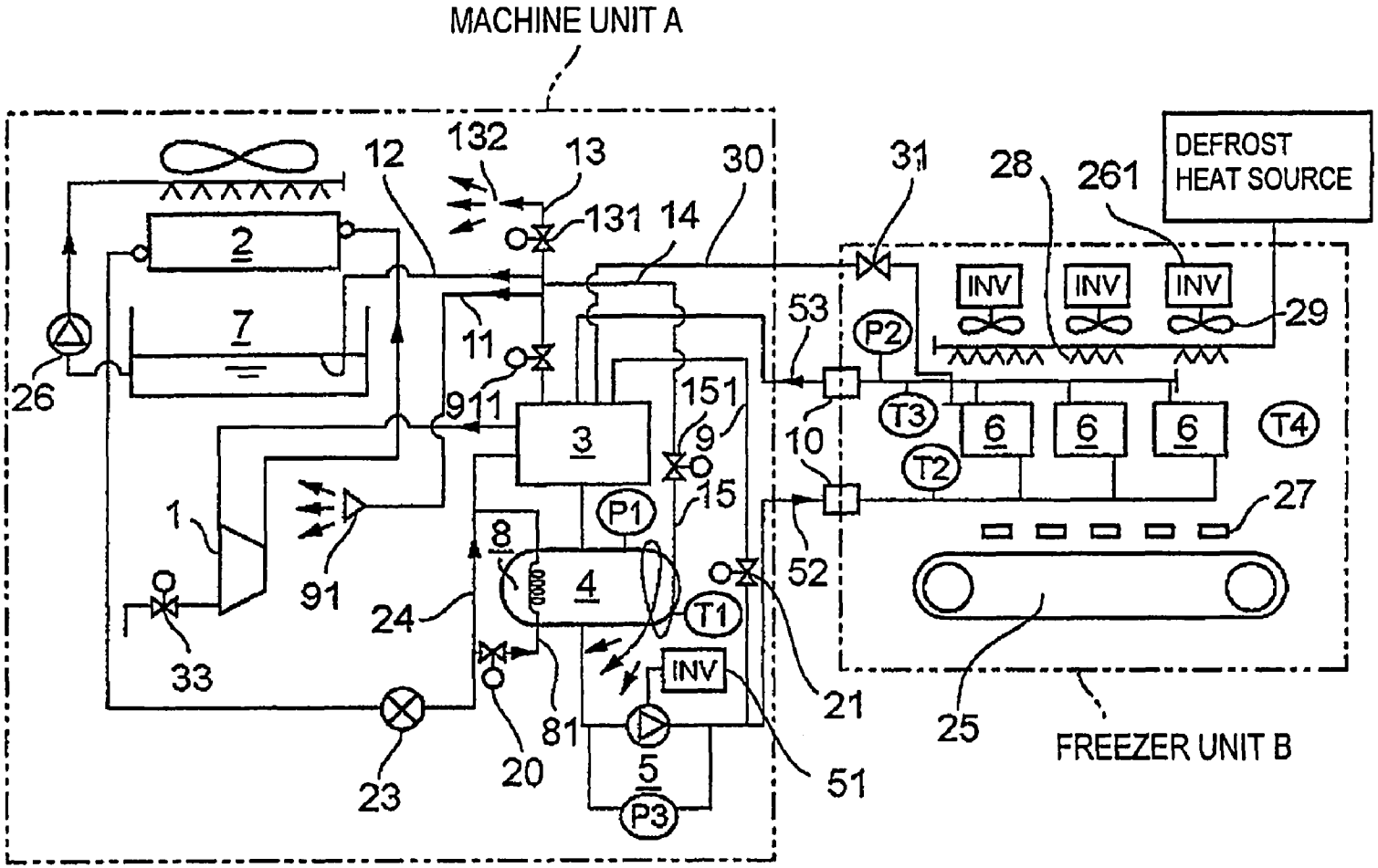
FIG. 3 is a schematic representation showing the total configuration of a machine unit ($CO_2$ brine producing unit) containing an ammonia refrigerating cycle section and an ammonia/$CO_2$ heat exchanging section and a freezer unit for refrigerating refrigeration load by utilizing latent heat of vaporization of liquid $CO_2$ brine cooled in the machine unit side to a liquid state.

Next, the construction of the machine unit A will be explained (see FIG. 3). In FIG. 3, reference numeral 1 is a compressor. Ammonia gas compressed by the compressor 1 is condensed in a condenser 2, then the condensed liquid ammonia is expanded at the expansion valve 23 to be introduced to a $CO_2$ brine cooler 3 to be evaporated therein while exchanging heat, and the evaporated ammonia gas is introduced into the compressor 1, thus an ammonia refrigerating cycle is performed. $CO_2$ brine cools a refrigeration load while evaporating in the freezer unit B is introduced to the brine cooler 3, where the mixture of liquid and gaseous $CO_2$ is cooled to be condensed by heat exchange with ammonia refrigerant, and the condensed liquid $CO_2$ is returned to the freezer unit B by means of a liquid pump 5 which is driven by an inverter motor of variable rotation speed and capable of intermittent rotation.

Next, the freezer unit B will be explained. The freezer unit B has a $CO_2$ brine line between the discharge side of the liquid pump 5 and the inlet side of the brine cooler 3, on the line is provided one or a plurality of coolers 6 capable of allowing evaporation in a liquid or liquid/gas mixed state (imperfectly evaporated state). The liquid $CO_2$ introduced to the freezer unit B is partly evaporated in the cooler or coolers 6, and $CO_2$ is returned to the $CO_2$ brine cooler of the machine unit A in a liquid or liquid/gas mixed state, thus a secondary refrigerant cycle of $CO_2$ is performed.

In FIG. 2(A), a top feed type cooler 6 and a bottom feed type cooler 6 are provided downstream of the liquid pump 5. A relief line 30 provided with a safety valve or pressure regulation valve 31 is provided between the coolers 6 capable of allowing evaporation in a liquid or liquid/gas mixed state and the brine cooler 3 in order to prevent undesired pressure rise due to gasified $CO_2$ which may tend to occur in the bottom feed type cooler and pressure rise on start up in addition to a recovery line 53 which is provided between the coolers 6 and the brine cooler 3. When the pressure in the coolers 6 rise above a predetermined pressure, the pressure regulation valve 31 opens to allow $CO_2$ to escape through the relief line 30.

FIG. 2(B) is an example when a single top feed type cooler is provided. In this case also a relief line 30 provided with a safety valve or pressure regulation valve 31 is provided between the coolers 6 capable of allowing evaporation in a liquid or liquid/gas mixed state and the brine cooler 3 in order to prevent pressure rise on start up in addition to a recovery line 53 which is provided between the coolers 6 and the brine cooler 3.

FIG. 2(C) is an example in which a plurality of liquid pumps are provided in the feed line 52 for feeding $CO_2$ to bottom feed type coolers 6 to generate forced circulation respectively independently. With the illustrated construction, even if there is not enough hydraulic head between the brine cooler 3 and the refrigeration load side cooler 6 and there is a somewhat long distance between them, required amount of $CO_2$ can be circulated forcibly. The discharge capacity of each of the pumps 5 should be above two times the flow required for each of the coolers 6 in order that $CO_2$ can be recovered in a liquid or liquid/gas mixed state.

FIG. 2(D) is an example when a single bottom feed type cooler is provided. In this case also a relief line 30 provided with a safety valve or pressure regulation valve 31 is provided between the coolers 6 and the brine cooler 3 in order to prevent pressure rise due to gasified $CO_2$ and pressure rise on start up in addition to a recovery line 53 which is provided between the coolers 6 and the brine cooler 3.

EXAMPLE 1

FIG. 3 is a schematic representation of the refrigerating apparatus of forced $CO_2$ circulation type in which $CO_2$ brine which has cooled a refrigeration load with its latent heat of vaporization is returned to be cooled through the heat exchange with ammonia refrigerant. In FIG. 3, reference symbol A is a machine unit ($CO_2$ brine producing apparatus) integrating an ammonia refrigerating cycle part and an ammonia/$CO_2$ heat exchanging part, and B is a freezer unit for cooling (refrigerating) a refrigeration load by utilizing the latent heat of vaporization of $CO_2$ cooled in the machine unit side.

Next, the machine unit A will be explained. In FIG. 3, reference numeral 1 is a compressor, the ammonia gas compressed by the compressor 1 is condensed in an evaporation type condenser 2, and the condensed liquid ammonia is expanded at an expansion valve 23 to be introduced into a $CO_2$ brine cooler 3 through a line 24. The ammonia evaporates in the brine cooler 3 while exchanging heat with $CO_2$ and introduced to the compressor 1 again to complete an ammonia cycle. Reference numeral 8 is a supercooler connected to a bypass pipe bypassing the line 24 between the outlet side of the expansion valve 23 and the inlet side of the brine cooler 3, the supercoller 8 being integrated in a $CO_2$ liquid reservoir 4.

Reference numeral 7 is an ammonia detoxifying water tank, the water sprinkled on the evaporation type ammonia condenser 2 and gathering into the water tank 7 being circulated by means of a pump 26. $CO_2$ brine recovered from the freezer unit B side through a heat insulated joint 10 is introduced to the $CO_2$ brine cooler 3, where it is cooled and condensed by the heat exchange with ammonia refrigerant, the condensed liquid $CO_2$ is introduced into the liquid reservoir 4 to be supercooled therein by the supercooler 8 to a temperature lower than saturation temperature of ammonia steam by 1~5 degrees C. The supercooled liquid $CO_2$ is introduced to the freezer unit B side by means of a liquid pump 5 provided in a $CO_2$ feed line 52 and driven by an inverter motor 51 of variable rotation speed. Reference numeral 9 is a bypass passage connecting the outlet side of the liquid pump 5 and the $CO_2$ brine cooler 3, and 11 is an ammonia detoxifying line, which connects to a detoxification nozzle 91 from which liquid $CO_2$ or liquid/gas mixed $CO_2$ from the $CO_2$ brine cooler 3 is sprayed to spaces where ammonia may leak such as near the compressor 1 by way of open/close valve 911. Reference numeral 12 is a neutralization line through which $CO_2$ is introduced from the $CO_2$ brine cooler 3 to the detoxifying water tank 7 to neutralize ammonia to ammonium carbonate. Reference numeral 13 is a fire extinguishing line. When a fire occurs in the unit, a valve 131 opens to allow $CO_2$ to be sprayed to extinguish the fire The valve 131 is a safety valve which opens upon detecting a temperature rise or upon detecting an abnormal pressure rise of $CO_2$ in the brine cooler 3. Reference numeral 14 is a $CO_2$ relief line. When temperature rises in the unit A, a valve 151 is opened and $CO_2$ in the $CO_2$ brine cooler 3 is allowed to be released into the space inside the unit through an injection line 15 surrounding the liquid reservoir 4 to cool the space. The valve 151 is composed as a safety valve which opens when the pressure in the brine cooler rises above a predetermined pressure during operation under load.

Next, the freezer unit B will be explained. In the freezer unit B, a plurality of $CO_2$ brine coolers 6 are located above a conveyor 25 for transferring foodstuffs 27 to be frozen along the transfer direction of the conveyor. Liquid $CO_2$ introduced through the heat insulated joint 10 is partially evaporated in the coolers 6, air brown toward the foodstuffs 27 by means of cooler fans 29 is cooled by the coolers 6 on its way to the foodstuffs. The cooler fans 29 are arranged along the conveyor 25 and driven by inverter motors 261 so that the rotation speed can be controlled. Defrosting spray nozzles 28 communicating to a defrost heat source are provided between the cooler fans 29 and the coolers 6. Gas/liquid mixed $CO_2$ generated by the partial evaporation in the coolers 6 returns to the $CO_2$ brine cooler 3 in the machine unit A through the heat insulated joint 10, thus a secondary refrigerant cycle is performed. A relief line 30 provided with a safety valve or pressure regulation valve 31 is provided between the coolers 6 capable of allowing evaporation in a liquid or liquid/gas mixed state and the brine cooler 3 or the liquid reservoir 4 provided in the downstream of the brine cooler in order to prevent undesired pressure rise due to gasified $CO_2$ and pressure rise on start up in addition to a recovery line for connecting the outlet side of each of the coolers 6 and the brine cooler 3.

Figure 4:
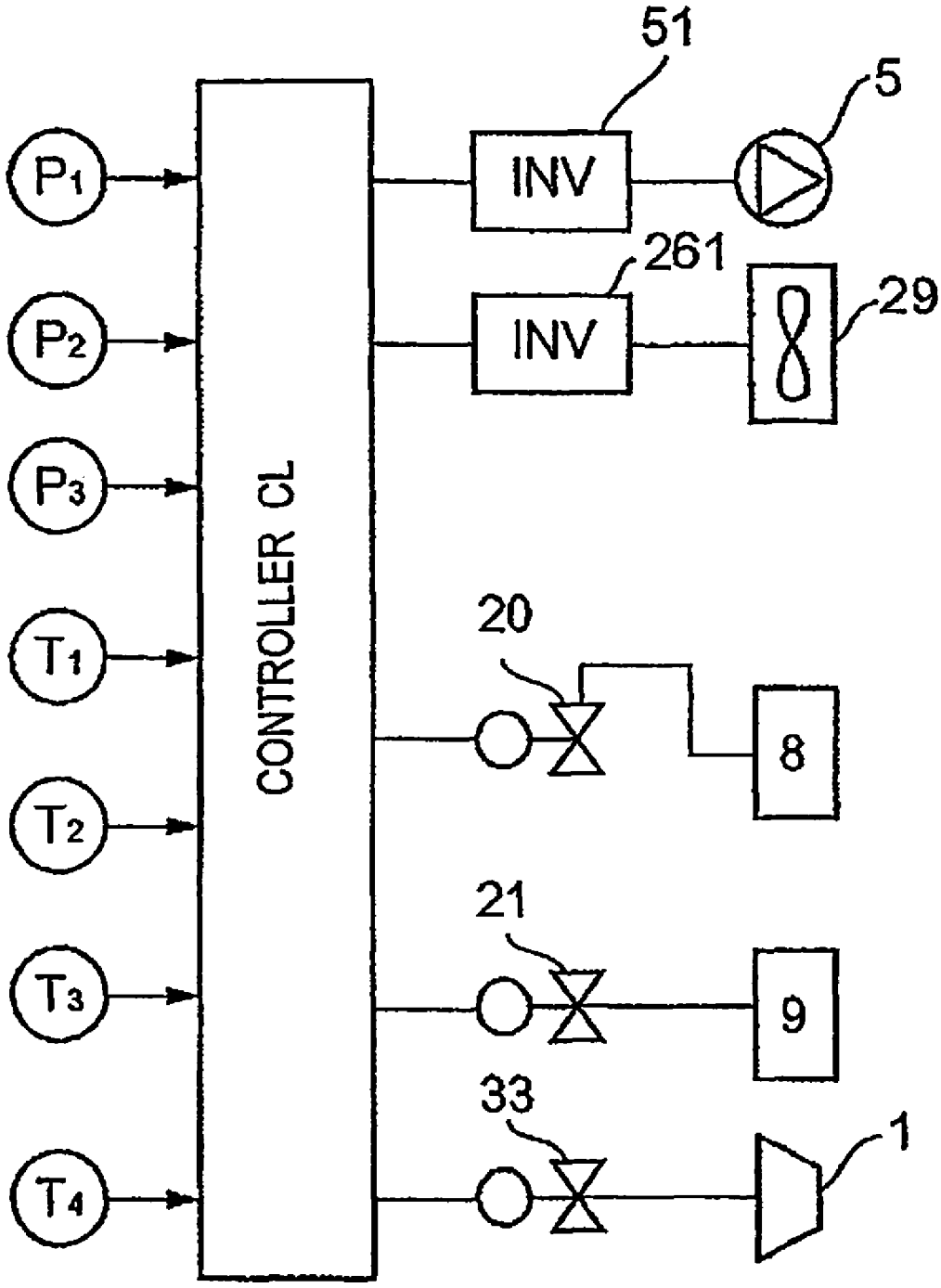
FIG. 4 is a flow diagram of the embodiment of FIG. 3.

The working of Example 1 will be explained with reference to FIG. 3 and FIG. 4. In the drawings, reference symbol $T_1$ is a temperature sensor for detecting the temperature of liquid $CO_2$ in the liquid reservoir 4, $T_2$ is a temperature sensor for detecting the temperature of $CO_2$ at the inlet side of the freezer unit B, $T_3$ is a temperature sensor for detecting the temperature of $CO_2$ at the outlet side of the freezer unit B, $T_4$ is a temperature sensor for detecting the temperature of the space in the freezer unit B, $P_1$ is a pressure sensor for detecting the pressure in the liquid reservoir 4, $P_2$ is a pressure sensor for detecting the pressure in the coolers 6, $P_3$ is a pressure sensor for detecting the pressure difference between the outlet and inlet of the liquid pump 5, CL is a controller for controlling the inverter motor 51 for driving the liquid pump 5 and the inverter motors 261 for driving the cooler fans 29. Reference numeral 20 is a open/close control valve of a bypass pipe 81 for supplying ammonia to the supercooler 8, 21 is a open/close control valve of the bypass passage 9 connecting the outlet side of the liquid pump 5 and the $CO_2$ brine cooler 3.

The Example 1 is composed such that the controller CL is provided for determining the degree of supercool by comparing saturation temperature and detected temperature of the liquid $CO_2$ based on the signals from the sensor $T_1$ and $P_1$ and the amount of ammonia refrigerant introduced to the bypass pipe 8 can be adjusted. By this, the temperature of $CO_2$ in the liquid reservoir 4 can be controlled to be lower than saturation temperature by 1~5 degrees C. The supercooler 8 may be provided outside the liquid reservoir 4 independently not necessarily inside the liquid reservoir 4. By this construction, all or a part of the liquid $CO_2$ in the liquid reservoir 4 can be supercooled by the supercooler 8 stably to a temperature of desired degree of supercooling.

The signal from the sensor $P_2$ detecting the pressure in the coolers 6 capable of allowing evaporation in a liquid or liquid/gas mixed state (imperfectly evaporated state) is inputted to the controller CL which controls the inverter motors 51 to adjust the discharge of the liquid pump 5 (the adjustment including stepless adjustment of discharge and intermittent discharging), and stable supply of $CO_2$ to the coolers 6 can be performed through controlling the inverter 51.

Further, the controller CL controls also the inverter motor 261 based on the signal from the sensor $P_2$, and the rotation speed of the cooler fan 29 is controlled together with that of the liquid pump 5 so that $CO_2$ liquid flow and cooling air flow are controlled adequately.

The liquid pump 5 for feeding $CO_2$ brine to freezer unit B side discharged 3~4 times the amount of $CO_2$ brine required by the refrigeration load side (freezer unit B side) to generate forced circulation of $CO_2$ brine, and the coolers 6 is filled with liquid $CO_2$ and the velocity of liquid $CO_2$ is increased by use of the inverter 51 resulting in an increased heat transmission performance. Further, as liquid $CO_2$ is circulated forcibly by means of the liquid pump 5 of variable discharge (with inverter motor) having discharge capacity of 3~4 times the flow necessary for the refrigeration load side, distribution of fluid $CO_2$ to the coolers 6 can be done well even in the case a plurality of coolers are provided.

Further, when the degree of supercool decreases when starting or refrigeration load varies and pressure difference between the outlet and inlet of the pump 5 decreases and cavitating state occurs, the sensor $P_3$ detecting the pressure difference detects that the pressure difference between the outlet and inlet of the pump has decreased, the controller CL allows the open/close control valve 21 on the bypass passage 9 to open, and $CO_2$ is bypassed to the $CO_2$ brine cooler 3, as a result the gas of the gas/fluid mixed state of $CO_2$ in a cavitating state can be liquefied.

The controlling can be done in the ammonia cycle in such a way that, when the degree of supercool decreases when starting or refrigeration load varies and pressure difference between the outlet and inlet of the pump 5 decreases and cavitating state occurs, the pressure sensor $P_3$ detects that pressure difference between the outlet and inlet of the liquid pump 5 has decreased, the controller CL controls a control valve to unload the compressor 1 (displacement type compressor) to allow apparent saturation temperature of $CO_2$ to rise to secure the degree of supercool.

Figure 5:
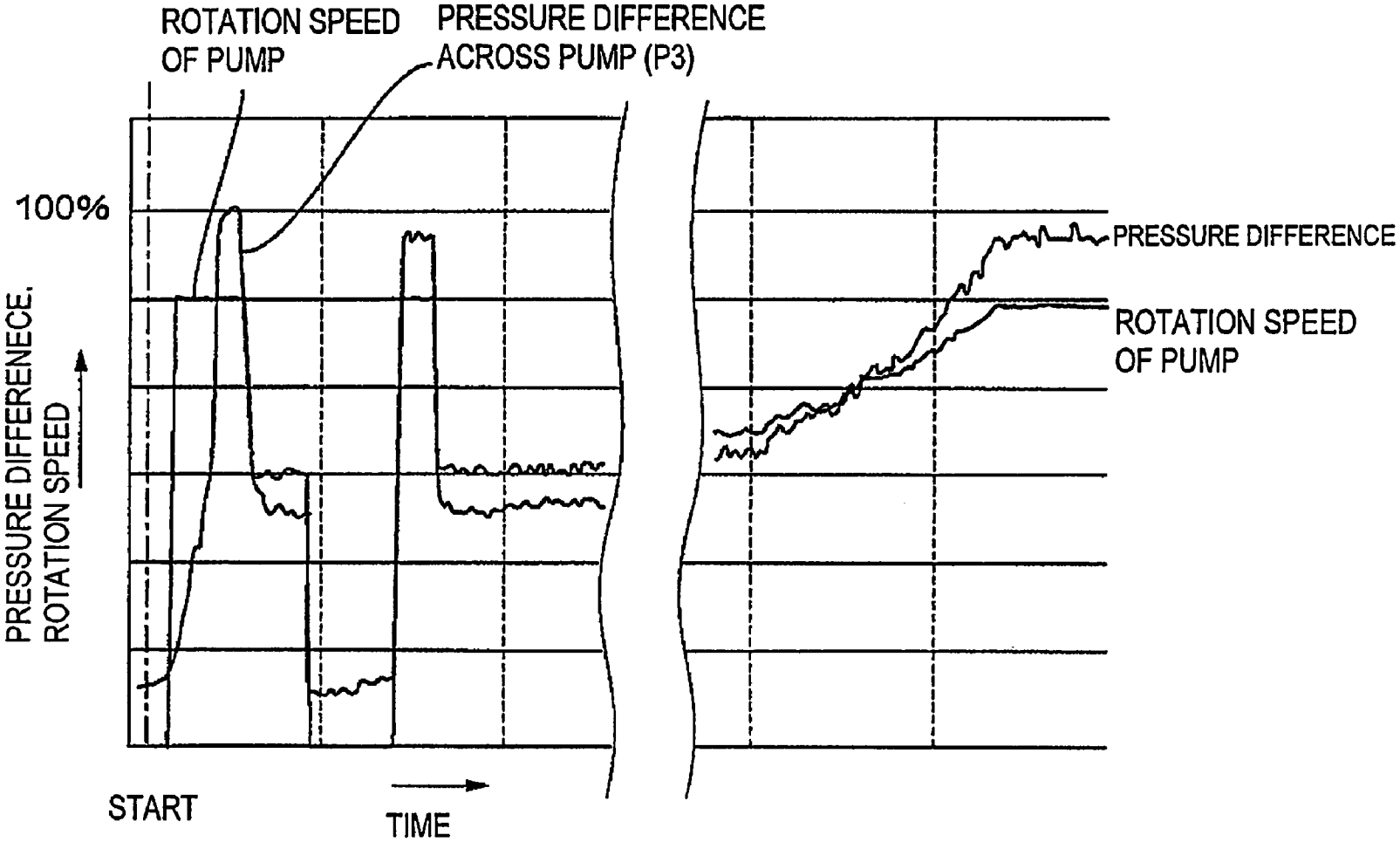
FIG. 5 is a graph showing changes of rotation speed of the liquid pump and pressure difference between the outlet and inlet of the liquid pump of the present invention.

Next, an operating method of Example 1 will be explained with reference to FIG. 5. First, the compressor 1 in the ammonia cycle side is operated to cool liquid $CO_2$ in the brine cooler 3 and the liquid reservoir 4. On startup, the liquid pump 5 is operated intermittently/cyclically. Specifically, the liquid pump 5 is operated at 0%→100%→60%→0%→100%→60% rotation speed. Here, 100% rotation speed means that the pump is driven by the inverter motor with the frequency of power source itself, and 0% means that the operation of the pump is halted. By operating in this way, the pressure difference between the outlet and inlet of the pump can be prevented from becoming larger than the design pressure.

First, the pump is operated under 100%, when the pressure difference between the outlet and inlet of the pump reaches the value of full load operation (full load pump head), lowered to 60%, then operation of the liquid pump is halted for a predetermined period of time, after this again operated under 100%, when the pressure difference between the outlet and inlet of the pump reaches the value of full load operation (full load pump head), lowered to 60%, then shifted to normal operation while increasing inverter frequency to increase the rotation speed of the pump. By operating in this way, the occurrence of undesired pressure rise above design pressure of the pump can be eliminated, for the operation of the system is started in a state of normal temperature also in the case the discharge capacity of the liquid pump is determined to be larger than 2 times, preferably 3→4 times the forced circulation flow required by the coolers capable of allowing evaporation in a liquid or liquid/gas mixed state (imperfectly evaporated state).

When sanitizing the freezer unit after freezing operation is over, $CO_2$ in the freezer unit B must be recovered to the liquid reservoir 4 by way of the brine cooler 3 of the machine unit. The recovery operation can be controlled by detecting the temperature of liquid $CO_2$ at the inlet side and that of gaseous $CO_2$ at the outlet side of the coolers 6 by the temperature sensor $T_2$, $T_3$ respectively, grasping by the controller CL the temperature difference between the temperatures detected by $T_2$ and $T_3$, and judging the remaining amount of $CO_2$ in the freezer unit B. That is, it is judged that recovery is completed when the temperature difference becomes zero.

The recovery operation can be controlled also by detecting the temperature of the space in the freezer unit and the pressure of $CO_2$ at the outlet side of the cooler 3 by the temperature sensor $T_4$ and pressure sensor $P_2$ respectively, comparing the space temperature detected by the sensor $T_4$ with saturation temperature of $CO_2$ at the pressure detected by the sensor $P_2$, and judging on the basis of the difference between the saturation temperature and the detected space temperature whether $CO_2$ remains in the freezer unit B or not.

In the case the coolers 6 are of sprinkled water defrosting type, time needed for $CO_2$ recovery can be shortened by utilizing the heat of sprinkled water. In this case, it is suitable to perform defrost control in which the amount of sprinkling water is controlled while monitoring the pressure of $CO_2$ at the outlet side of the coolers 6 detected by the sensor $P_2$.

Further, as foodstuffs are handled in the freezer unit B, high-temperature sterilization of the unit may performed when an operation is over. So, the connecting parts of $CO_2$ lines of the machine unit A to those of the freezer unit B are used heat insulated joint made of low heat conduction material such as reinforced glass, etc. so that the heat is not conducted to the $CO_2$ lines of the machine unit A through the connecting parts.

EXAMPLE 2

Figure 6:
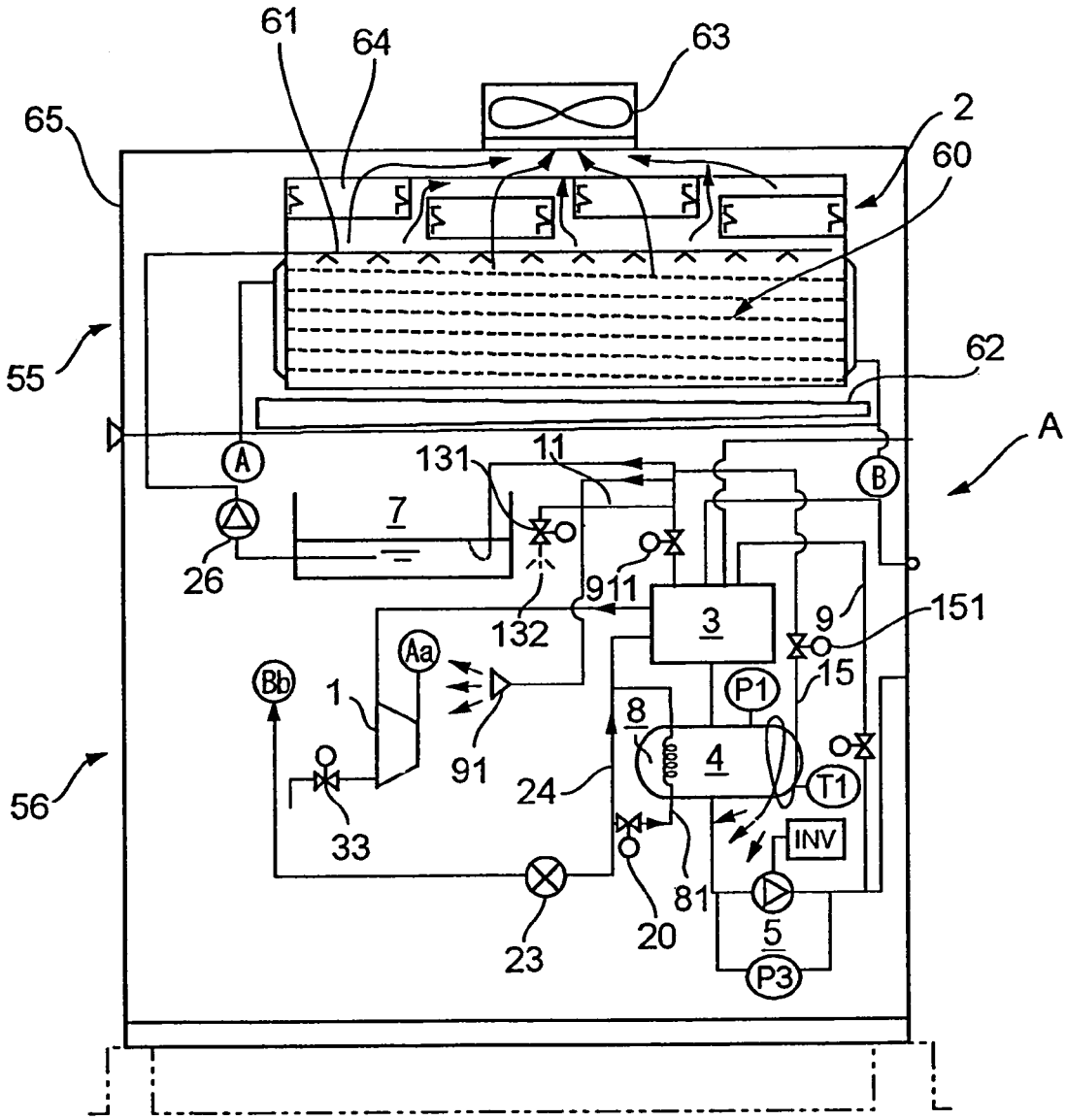
FIG. 6 is a schematic representation of the second embodiment showing schematically the configuration of an ammonia refrigerating unit provided with an evaporation type condenser.
Figure 7:
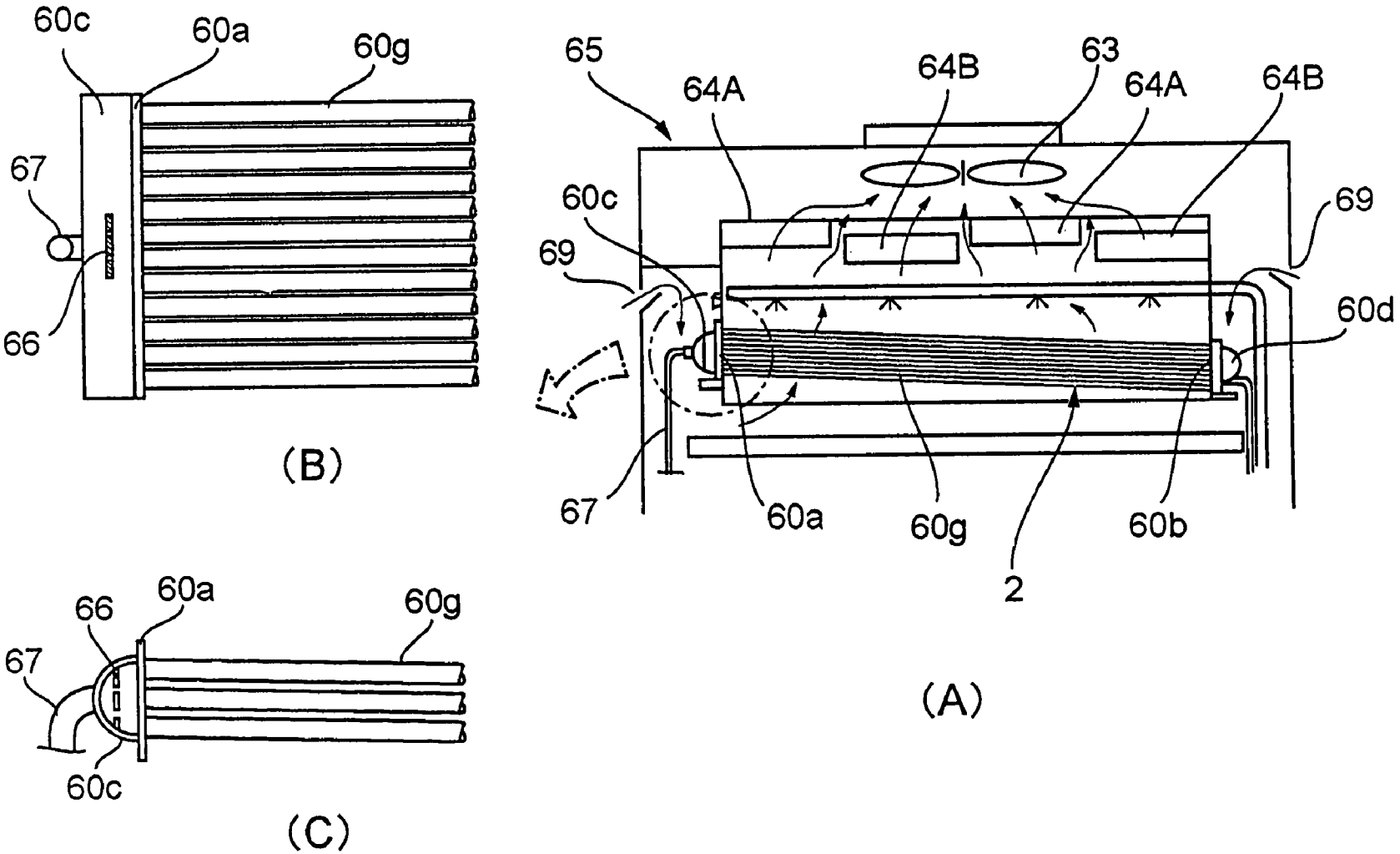
FIG. 7(A) is a partial cutaway view to show the construction of the evaporation type condenser of the ammonia refrigeration unit of FIG. 6.
FIG. 7(B) is a horizontal sectional view of the part surrounded by a circle of chin line in FIG. 7(A)
FIG. 7(C) is a vertical sectional view of the same part.
Figure 8:
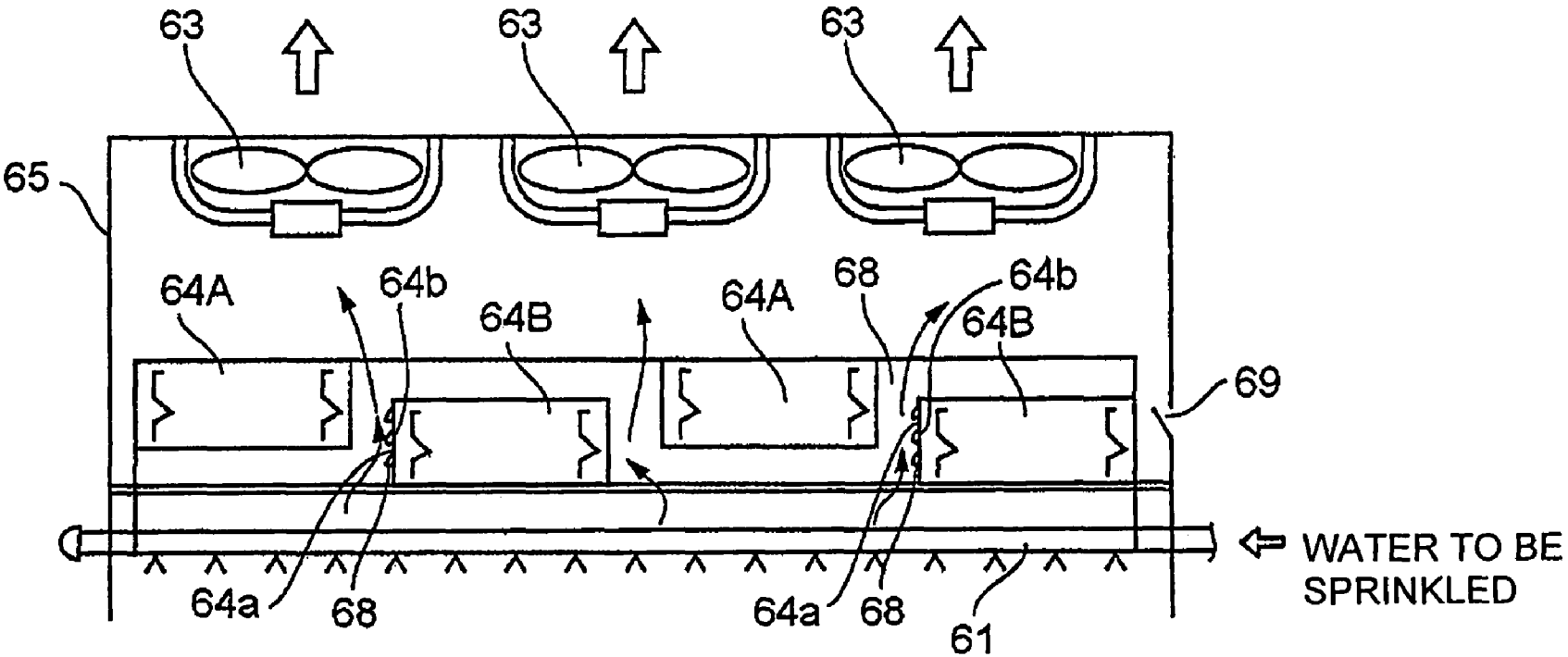
FIG. 8 is a detail view of arrangement of eliminators of the unit of FIG. 6.
Figure 9A:
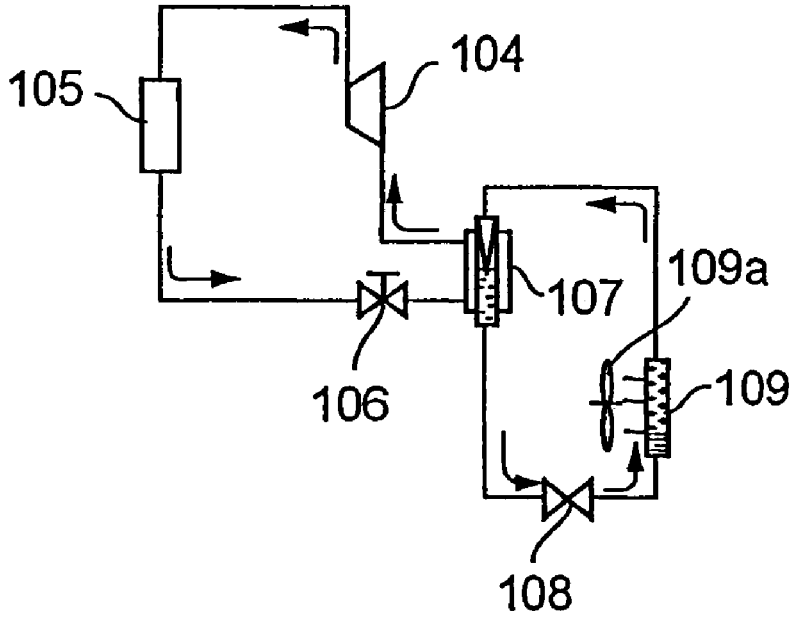
FIG. 9A Prior Art
FIGS. 9(A) and 9(B) are refrigeration systems of prior art combining an ammonia cycle and a $CO_2$ cycle.
Figure 9B:
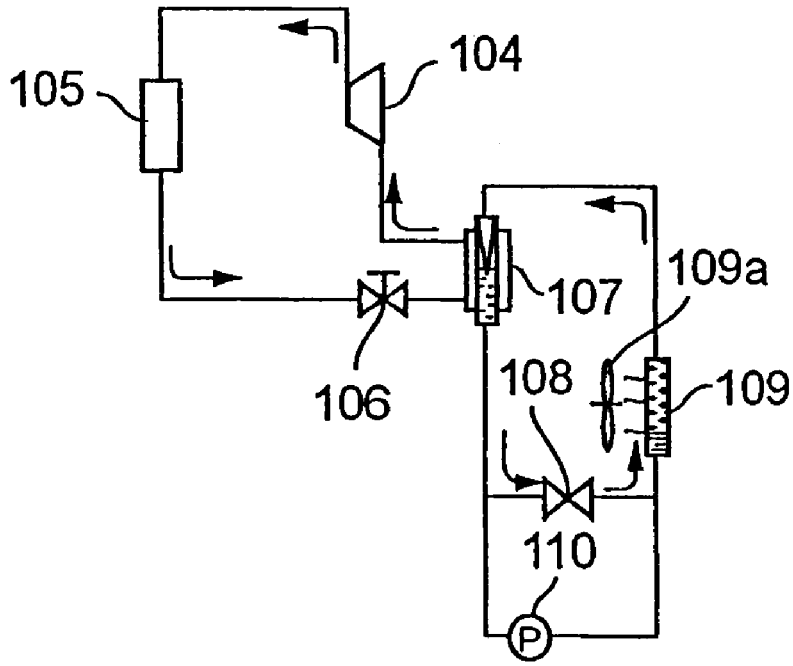
FIG. 9B Prior Art
Figure 10:
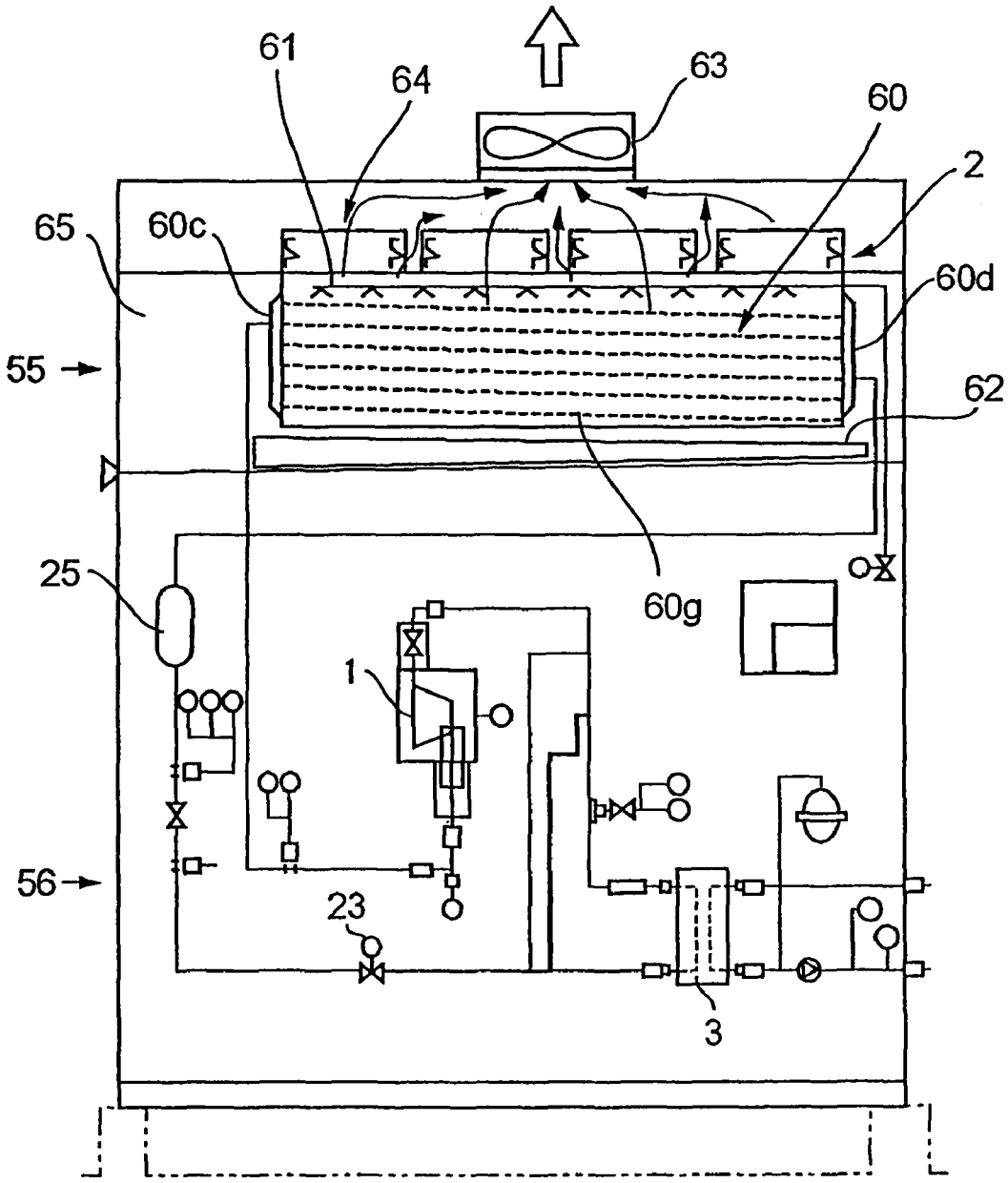
FIG. 10 Prior Art
FIG. 10 is a schematic representation of an ammonia refrigerating unit of prior art provided with an evaporation type condenser.

FIG. 6~8 show an example when the machine unit of FIG. 3 is constructed such that an ammonia cycle part and a part of carbon dioxide cycle part are unitized and accommodated in an unit to compose an ammonia refrigerating unit. As shown in FIG. 6, the ammonia refrigerating unit A of the invention is located out of doors, and the cold heat (cryogenic heat) of $CO_2$ produced by the unit A is transferred to a refrigeration load such as the freezer unit of FIG. 3. The ammonia refrigerating unit A consists of two construction bodies, a lower construction body 56 and an upper construction body 55.

The lower construction body 56 contains devices of ammonia cycle excluding an evaporation type condenser and a part of devices of $CO_2$ cycle. To the upper construction body 55 are attached a drain pan 62, an evaporation type condenser 2, outer casing 65, a cooling fan 63, etc. The evaporation type condenser 2 is composed of an inclined multitubular heat exchanger 60, water sprinkler head 61, eliminators 64 arranged stepwise, a cooling fan 63, etc. Outside air is sucked by the cooling fan to be introduced from air inlet openings 69 (see FIG. 7(A)). The air flows from under the evaporation type condenser 2 upward to the heat exchanger 60. Water is sprinkled from the water sprinkler head 61 on the cooling tubes of the heat exchanger. High-pressure, high-temperature ammonia gas flowing in the cooling tubes is cooled by the sprinkled water and the air sucked by the cooling fan, and leaked ammonia, if leakage occurs, gathers to the space above the drain pan and dissolved into the sprinkled water to be detoxified.

As shown in FIG. 7, the inclined multitubular heat exchanger 60 comprises a plurality of inclined cooling tubes 60*g*, the tubes penetrating tube supporting plates 60*a* and 60*b* of both sides and inclining from an inlet side header 60*c* downward to an outlet side header 60*d*. By virtue of the inclination of the cooling tubes 60*g*, the refrigerant gas introduced from the inlet side header 60*c* is cooled and condensed in the process of flowing toward the outlet side header 60*d* by the air and sprinkled water, and the liquid film of the refrigerant formed on the inner surface of the cooling tube does not stagnate and moves downward toward the outlet side header 60*d*. Therefore, the refrigerant gas is condensed with high efficiency in the cooling tubes and the staying time of the refrigerant in the heat exchanger can be shortened. As a result, an improvement in condensing efficiency and a significant reduction of the amount of refrigerant retained in the unit can be achieved by using the heat exchanger mentioned above.

The inlet header 60*c* is, as shown in FIG. 7(C), formed to have a semicircular section, and a baffle plate having a plurality of holes is attached inside the header in the position facing the opening of the inlet duct 67. The ammonia gas introduced from the opening of the inlet duct 67 impinges against the baffle plate 66, and a part of the ammonia gas passes through the holes of the baffle plate 66 to proceed to the cooling tubes located in the rear of the baffle plate 66 and other part of the ammonia refrigerant is turned toward both sides of the baffle plate to be guided to enter the cooling tubes located in the remote side from the center if the opening of the inlet duct 67, as a result the ammonia gas is introduced uniformly in the cooling tubes 10*g* as can be understood from FIG. 7(B).

The drain pan 62 which receives cooling water sprinkled from the water sprinkler head 61 is located under the inclined multitubular heat exchanger 60 and forms a boundary between the lower construction body 56 and the upper construction body 55. The bottom plate of the drain pan 62 is shaped like a shallow funnel such that the cooling water fallen into the drain pan flows smoothly toward a drain pipe (not shown in the FIG. 6) without being trapped in the drain pan to be exhausted to an ammonia detoxifying water tank 7.

The eliminators 64 located between the cooling fan and the water sprinkler head 61 are arranged to be positioned adjacent to each other. The eliminator 64A and 64B positioned adjacent to each other are positioned to be stepped with each other so that the upper part of the side wall of the eliminator 64B faces the lower part of the side wall of the eliminator 64A. The step, i.e. the distance between the bottom of the eliminator 64A and the top of the eliminator 64B is determined to be about a half of their height, concretively about 50 mm.

As a result, as shown in FIG. 8, the water droplets 68 scattered from the sprinkler head 61 impinges against the side wall 64*a* of the lower eliminator 64B positioned adjacent to the upper eliminator 64A, and the droplets grow large. The large droplets are less apt to be sucked by the cooling fans 63, therefore the droplets can be prevented from flying upward. FIG. 8 is an embodiment with a plurality of cooling fans provided.

It should be noted that in FIG. 6, the part A surrounded by a circle is connected to the part Aa surrounded by a circle, and the part B surrounded by a circle is connected to the part Bb surrounded by a circle.

As is described in the foregoing, according to the present invention, an ammonia refrigerating cycle, a $CO_2$ brine cooler (ammonia evaporator) to cool and liquefy the $CO_2$ by utilizing the latent heat of vaporization of the ammonia, and a $CO_2$ brine producing apparatus having a liquid pump in the $CO_2$ supply line for supplying $CO_2$ to the refrigeration load side are unitized in a single unit, and the ammonia cycle and $CO_2$ brine cycle can be combined without problems even when refrigeration load such as refrigerating showcase, etc. is located in any place in accordance with circumstances of customer's convenience.

Further, according to the present invention, $CO_2$ circulation cycle can be formed irrespective of the position of the $CO_2$ cycle side cooler, kind thereof (bottom feed type of top feed type), and the number thereof, and further even when the $CO_2$ brine cooler is located at a position lower than the refrigeration load side cooler.

Further, according to the present invention, an ammonia refrigerating unit including an evaporation type condenser is composed, in which, when eliminators are located between the condenser section and cooling fan, pressure loss of cooling air flow passing through the eliminators can be decreased.

Further, according to the present invention, when an ammonia refrigerating unit is composed by unitizing an ammonia system and a part of a carbon dioxide system to be accommodated in a space, toxic ammonia leakage is easily detoxified and the occurrence of fire caused by ignition of ammonia gas can be easily prevented even if leakage occurs.

What is claimed is:

1. An ammonia/$CO_2$ refrigeration system comprising:

apparatuses working on an ammonia refrigerating cycle using ammonia;

a brine cooler for cooling and condensing $CO_2$ by utilizing the latent heat of vaporization of the ammonia from the ammonia refrigeration cycle;

a refrigeration load side cooler located at a higher gravitational level than the brine cooler;

a supply line for supplying the cooled and liquefied $CO_2$ from the brine cooler to the refrigeration load side cooler;

a return line for returning $CO_2$ from the refrigeration load side cooler to the brine cooler;

a liquid pump provided in the supply line, the liquid pump being a variable-discharge pump that forcibly circulates $CO_2$ between the brine and refrigeration load side coolers, and having a discharge capacity that is equal to or greater than twice the circulation flow required by the refrigeration load side cooler to evaporate $CO_2$ in a liquid or liquid/gas mixed state (imperfectly evaporated state) to allow the brine cooler to recover $CO_2$ in the liquid state or liquid/gas mixed state;

a controller that controls $CO_2$ recovery by controlling circulation volume of the $CO_2$ circulated by the liquid pump to maintain the $CO_2$ returning from the refrigeration load side cooler in the liquid or liquid/gas mixed state; and a $CO_2$ gas return passage connecting the refrigeration load side cooler to the brine cooler or to a liquid reservoir provided downstream of the brine cooler with respect to a flow direction of the refrigerant, wherein the $CO_2$ gas return passage is provided separately from the return line for returning excess $CO_2$ gas to the brine cooler or the liquid reservoir to liquefy the returned $CO_2$ gas in the brine cooler or the liquid reservoir and reduce $CO_2$ pressure when the pressure in the load side cooler is equal to or higher than a predetermined value.

2. The ammonia/$CO_2$ refrigeration system according to claim 1, wherein the refrigeration load side cooler is of a top feed type.

3. The ammonia/$CO_2$ refrigeration system according to claim 1, wherein the liquid pump is connected to a drive that provides at least one of an intermittent or variable speed.

4. The ammonia/$CO_2$ refrigeration system according to claim 3, wherein:

the controller controls the drive connected to the liquid pump, the controller controls the drive intermittently at starting to allow the liquid pump to be operated under discharge pressure lower than designed permissible pressure, and thereafter controls rotation speed.

5. The ammonia/$CO_2$ refrigeration system according to claim 1, further comprising:

a temperature detector that detects a temperature of a space of a chamber containing the refrigeration load side cooler;

a $CO_2$ pressure detector that detects a $CO_2$ pressure at an outlet of the refrigeration load side cooler, wherein the controller controls the timing of stopping of a cooling fan of the refrigeration load side cooler and determines the amount of $CO_2$ remaining in the refrigeration load side cooler by comparing the saturation temperature of $CO_2$ at the detected pressure and the temperature of the space.

6. The ammonia/$CO_2$ refrigeration system according to claim 1, wherein the supply line extending from an outlet of the liquid pump is connected to an inlet of the refrigeration load side via a heat insulated joint.

7. The ammonia/$CO_2$ refrigeration system according to claim 1, further comprising:

a pressure detector detecting a pressure of $CO_2$ at an outlet of the refrigeration load side cooler, wherein the controller controls circulation flow of $CO_2$ discharged by the liquid pump based on the pressure of $CO_2$ detected by the pressure detector.

8. An ammonia/$CO_2$ refrigeration system comprising:

apparatuses working on an ammonia refrigerating cycle using ammonia;

a brine cooler for cooling and condensing $CO_2$ by utilizing the latent heat of vaporization of the ammonia from the ammonia refrigeration cycle;

a refrigeration load side cooler;

a supply line for supplying the cooled and liquefied $CO_2$ from the brine cooler to the refrigeration load side cooler;

a return line for returning $CO_2$ from the refrigeration load side cooler to the brine cooler;

a liquid pump provided in the supply line, the liquid pump being a variable-discharge pump that forcibly circulates $CO_2$ between the brine and refrigeration load side coolers, and having a discharge capacity that is equal to or greater than twice the circulation flow required by the refrigeration load side cooler to evaporate $CO_2$ in a liquid or liquid/gas mixed state (imperfectly evaporated state) to allow the brine cooler to recover $CO_2$ in the liquid state or liquid/gas mixed state;

a controller that controls $CO_2$ recovery by controlling circulation volume of the $CO_2$ circulated by the liquid pump to maintain the $CO_2$ returning from the refrigeration load side cooler in the liquid or liquid/gas mixed state; and a $CO_2$ gas return passage connecting the refrigeration load side cooler to the brine cooler or to a liquid reservoir provided downstream of the brine cooler with respect to a flow direction of the refrigerant, wherein the $CO_2$ gas return passage is provided separately from the return line for returning excess $CO_2$ gas to the brine cooler or the liquid reservoir to liquefy the returned $CO_2$ gas in the brine cooler or the liquid reservoir and reduce $CO_2$ pressure when the pressure in the load side cooler is equal to or higher than a predetermined value, wherein the refrigeration load side cooler is a defrosting type cooler including a water sprinkling device for sprinkling water for defrosting, and wherein the controller controls $CO_2$ recovery while water is being sprinkled for defrosting.

9. The ammonia/$CO_2$ refrigeration system according to claim 8, further comprising:

a pressure detector for detecting $CO_2$ pressure at an outlet of the refrigeration load side cooler, wherein the controller controls the amount of water sprinkled based on the detected pressure.

10. The ammonia/$CO_2$ refrigeration system according to claim 8, wherein the refrigeration load side cooler is located at a same or higher gravitational level than the brine cooler.

11. A $CO_2$ brine production system comprising:

apparatuses working on an ammonia refrigerating cycle using ammonia;

a brine cooler for cooling and condensing $CO_2$ by utilizing the latent heat of vaporization of the ammonia from the ammonia refrigeration cycle;

a refrigeration load side cooler located at a higher gravitational level than the brine cooler;

a supply line for supplying the cooled and liquefied $CO_2$ from the brine cooler to the refrigeration load side cooler;

a return line for returning $CO_2$ from the refrigeration load side cooler to the brine cooler;

a liquid pump provided in the supply line, the liquid pump being a variable-discharge pump that forcibly circulates $CO_2$ between the brine and refrigeration load side coolers, and having a discharge capacity that is equal to or greater than twice the circulation flow required by the refrigeration load side cooler to evaporate $CO_2$ in a liquid or liquid/gas mixed state (imperfectly evaporated state) to allow the brine cooler to recover $CO_2$ in the liquid state or liquid/gas mixed state; and a controller that controls $CO_2$ recovery by controlling circulation volume of the $CO_2$ circulated by the liquid pump to maintain the $CO_2$ returning from the refrigeration load side cooler in the liquid or liquid/gas mixed state; and a $CO_2$ gas return passage connecting the refrigeration load side cooler to the brine cooler or to a liquid reservoir provided downstream of the brine cooler with respect to a flow direction of the refrigerant, wherein the $CO_2$ gas return passage is provided separately from the return line for returning excess $CO_2$ gas to the brine cooler or the liquid reservoir to liquefy the returned $CO_2$ gas in the brine cooler or the liquid reservoir and reduce $CO_2$ pressure when the pressure in the load side cooler is equal to or higher than a predetermined value.

12. The $CO_2$ brine production system according to claim 11, further comprising:

the liquid reservoir holding the cooled and liquefied $CO_2$ from the brine cooler; and a supercooler that supercools at least part of the liquid $CO_2$ in the liquid reservoir based on a supercooled state of $CO_2$ in the liquid reservoir or in the supply line.

13. The $CO_2$ brine production system according to claim 12, further comprising:

a pressure detector for detecting $CO_2$ pressure in the reservoir; and a temperature detector for detecting liquid $CO_2$ temperature in the reservoir, wherein the controller compares the saturation temperature at the detected pressure with the detected liquid temperature, and determines the supercooled state of $CO_2$ based on the degree of supercooling that is determined by comparing the saturation temperature and the detected liquid temperature.

14. The $CO_2$ brine production system according to claim 12, further comprising:

a pressure sensor that detects pressure difference between outlet and inlet of the liquid pump, wherein the controller determines the supercooled state of $CO_2$ based on the signal from the pressure sensor.

15. The $CO_2$ brine production system according to claim 12, wherein the supercooler is an ammonia gas line branched to bypass a line for introducing ammonia to an ammonia evaporator in the ammonia refrigerating cycle.

16. The $CO_2$ brine production system according to claim 11, further comprising:

a bypass passage provided between an outlet side of the liquid pump and the brine cooler; and an open/close control valve in the bypass passage.

17. The $CO_2$ brine production system according to claim 11, further comprising:

a pressure sensor that detects pressure difference between outlet and inlet of the liquid pump, wherein the controller forcibly unloads a compressor in the ammonia refrigerating cycle based on the detected pressure difference between the outlet and the inlet of the liquid pump.

18. An ammonia cooling unit for producing $CO_2$ brine comprising:

an ammonia compressor for compressing ammonia;

a brine cooler for cooling and condensing $CO_2$ by utilizing the latent heat of vaporization of the ammonia;

a refrigeration load side cooler located at a higher gravitational level than the brine cooler;

a supply line for supplying the cooled and liquefied $CO_2$ from the brine cooler to a refrigeration load side cooler;

a return line for returning $CO_2$ from the refrigeration load side cooler to the brine cooler;

a liquid pump provided in the supply line, the liquid pump being a variable-discharge pump that forcibly circulates $CO_2$ between the brine and refrigeration load side coolers, and having a discharge capacity that is equal to or greater than twice the circulation flow required by the refrigeration load side cooler to evaporate $CO_2$ in a liquid or liquid/gas mixed state (imperfectly evaporated state) to allow the brine cooler to recover $CO_2$ in the liquid state or liquid/gas mixed state;

a controller that controls $CO_2$ recovery by controlling circulation volume of the $CO_2$ circulated by the liquid pump to maintain the $CO_2$ returning from the refrigeration load side cooler in the liquid or liquid/gas mixed state; and a $CO_2$ gas return passage connecting the refrigeration load side cooler to the brine cooler or to a liquid reservoir provided downstream of the brine cooler with respect to a flow direction of the refrigerant, wherein the $CO_2$ gas return passage is provided separately from the return line for returning excess $CO_2$ gas to the brine cooler or the liquid reservoir to liquefy the returned $CO_2$ gas in the brine cooler or the liquid reservoir and reduce $CO_2$ pressure when the pressure in the load side cooler is equal to or higher than a predetermined value.

19. The ammonia cooling unit according to claim 18, further comprising:

a $CO_2$ injection line for injecting $CO_2$ inside space of a chamber housing the ammonia cooling unit.

20. The ammonia cooling unit according to claim 18, further comprising:

a $CO_2$ spouting part for releasing $CO_2$ inside a space of a chamber housing the ammonia housing the ammonia cooling unit, wherein open/close control of the spouting part is done based on the temperature of the space of the chamber or the $CO_2$ pressure in the brine cooler or the refrigeration load side cooler.

21. The ammonia cooling unit according to claim 18, further comprising:

the liquid reservoir for holding the cooled and liquefied $CO_2$ from the brine cooler;

an injection line surrounding the liquid reservoir; and a supercooler for supercooling the liquid $CO_2$ in the liquid reservoir, wherein the $CO_2$ spouting part is formed at an extremity of an injection line surrounding the liquid reservoir in which the supercooler is provided for supercooling the liquid $CO_2$ therein at least partially based on cooling condition of the liquid $CO_2$ in the liquid reservoir or in the supply line, or contacts the supercooler when the supercooler is provided outside the liquid reservoir.

22. The ammonia cooling unit according to claim 18, further comprising:

an evaporation type condenser located in an opened space side of the ammonia cooling unit and including a heat exchanger comprising cooling tubes, water sprinkler, a plurality of eliminators arranged side by side, and at least one cooling fan, wherein the eliminators positioned adjacent to each other are staggered with each other in a vertical direction.

23. The ammonia cooling unit according to claim 22, wherein the heat exchanger is an inclined multitubular heat exchanger having an inlet header for introducing compressed ammonia gas to be distributed to flow into the cooling tubes, and a baffle plate is attached to the header at a position facing the inlet opening for introducing compressed ammonia gas.

24. The ammonia cooling unit according to claim 18, further comprising:

a water tank for detoxifying ammonia inside a chamber housing the ammonia cooling unit; and a neutralization line for introducing $CO_2$ to the water tank.

* * * * *